United States Patent [19]

Walker et al.

[11] Patent Number: 5,055,083

[45] Date of Patent: Oct. 8, 1991

[54] TOY STORE

[76] Inventors: Robert Walker; Betty R. Walker, both of 2400 Rock Hill Rd., Castle Hayne, N.C. 28429

[21] Appl. No.: 619,471

[22] Filed: Nov. 29, 1990

[51] Int. Cl.[5] ..... A63H 33/04

[52] U.S. Cl. ..... 446/478; 446/476; 446/71

[58] Field of Search ..... 446/71, 76, 80, 85, 446/108, 122, 476, 478, 487, 489

[56] References Cited

U.S. PATENT DOCUMENTS

| | | | |
|---|---|---|---|
| Re. 18,738 | 2/1933 | Gilmond . | |
| D. 47,044 | 3/1915 | McAllister . | |
| D. 48,766 | 3/1916 | Becker . | |
| D. 170,143 | 4/1953 | Beethoven . | |
| D. 236,742 | 7/1979 | Goodwin . | |
| D. 252,292 | 7/1979 | Johnson . | |
| 983,133 | 1/1911 | Goldfield . | |
| 1,521,420 | 8/1923 | Beebe . | |
| 1,530,546 | 4/1922 | Cowen . | |
| 2,059,964 | 11/1936 | Hempstone | 446/76 |
| 2,342,264 | 1/1944 | Fuehrer | 446/487 X |
| 3,400,485 | 9/1968 | Callin et al. | 446/76 |
| 3,603,004 | 9/1971 | Fink | 448/108 X |
| 3,849,930 | 11/1974 | Stubbman . | |
| 4,717,214 | 1/1988 | Moore et al. | 446/487 X |
| 4,883,443 | 11/1989 | Chase | 446/487 X |
| 4,978,301 | 12/1990 | Dodge | 446/108 X |

FOREIGN PATENT DOCUMENTS

| | | | |
|---|---|---|---|
| 2113108 | 8/1983 | United Kingdom | 446/478 |

*Primary Examiner*—Mickey Yu
*Assistant Examiner*—Sam Rimell
*Attorney, Agent, or Firm*—Rosenthal & Putterman

[57] ABSTRACT

A toy store is disclosed that when stored is a single-story, box-like structure, and when in use, walls are movable to form a second floor. Store related fixture accessories are provided.

8 Claims, 4 Drawing Sheets

TOY STORE

FIELD OF THE INVENTION

This invention relates generally to the field of toy stores and more particularly, to toy stores of the type having multiple stories.

BACKGROUND OF THE INVENTION

Doll house stores are well known, however, those produced to date have been relatively uninteresting. For example, U.S. Pat. No. 983,183 to Goldfield discloses a toy store which is adapted to be closed when not in use and when opened reveals a one room or shop including shelves and a sign. Another single-story toy store is found in U.S. Pat. No. 18,738 which is composed of sections hinged to one another and adapted to be folded together to simulate the exterior appearance of a store and unfolded to render shelves, etc. available in simulation of the interior of a store. Another toy playhouse is taught in U.S. Pat. No. 3,849,930 to Stubbmann which has a front side open to expose "rooms" of a simulated multilevel residence apartment, separated by a central vertically disposed partition from a rear side open to expose several "departments" of a simulated multilevel department store. Also provided are magnetized play figures and furnishings to be used with the respective apartment and store. However, even this toy store is not without its shortcomings. For example, there is no way to close the structure when not in use to prevent the loss or misplacement of pieces. Also, there are no display pieces which can be arranged or interchanged.

With the foregoing in mind, it is an object of the invention to provide a toy store.

Another object of the invention is to provide a toy store which when in use is a two-story store and when not in use is closable to provide a single-story in order to contain the component parts thereof.

Yet another object of the invention is to provide a toy store which includes display pieces which are realistic and movable.

BRIEF DESCRIPTION OF THE DRAWINGS

Some of the objects of the invention having been stated, other objects will appear as the description proceeds, when taken in connection with the accompanying drawings, in which—

SUMMARY OF THE INVENTION

The foregoing objects of the present invention are accomplished by providing a toy store comprising a vertical front wall including a door and a window. A floor member is connected to the front wall along its bottom portion and a ceiling member is similarly connected to the front wall along its top portion and substantially overlies the floor member. A facade wall adapted to be connected along its lower edge to the ceiling member when the top story is in use and further including means for detachably connecting the facade wall between the floor member and the ceiling member when the toy store is in storage. A rectilinear side wall is hingedly connected to each of the respective sides of the ceiling member. Each side wall is movable from a closed position wherein the free end of the side wall is detachably connected to the floor member and is movable to a vertical position to define second-story walls.

DETAILED DESCRIPTION OF THE ILLUSTRATED EMBODIMENT

While the present invention will be described more fully hereinafter with reference to the accompanying drawings, in which a particular embodiment is shown, it is to be understood at the outset that persons skilled in the art may modify the invention herein described while still achieving the favorable results of this invention. Accordingly, the description which follows is to be understood as a broad teaching disclosure directed to persons of skill in the appropriate arts and not as limiting upon the present invention.

Figure 3:
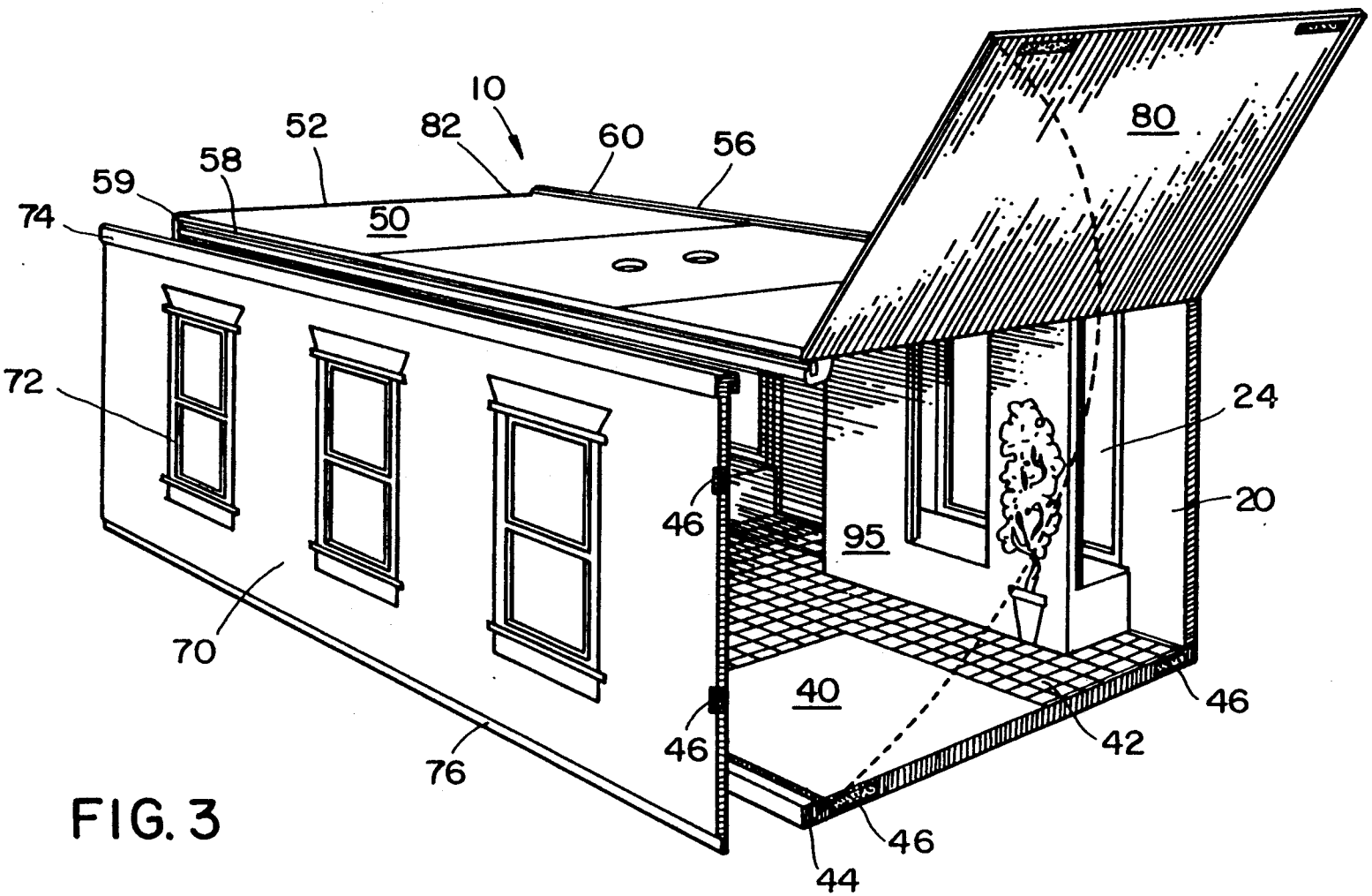
FIG. 3 is a perspective view of the rear of the toy store showing the store being closed for storage.

Referring now to the drawings, the toy store is generally indicated at 10. The toy store is collapsible to form a box-like structure during storage which when closed holds accessories (FIG. 1) and when opened, forms a simulated toy or play store having two levels (FIG. 3). More specifically, the toy store comprises a front wall 20, a floor member, a ceiling member, a facade wall and a pair of side walls, which when arranged (as will be described hereinbelow) change the store from a closed storage container to a simulated two-story toy store.

Figure 1:
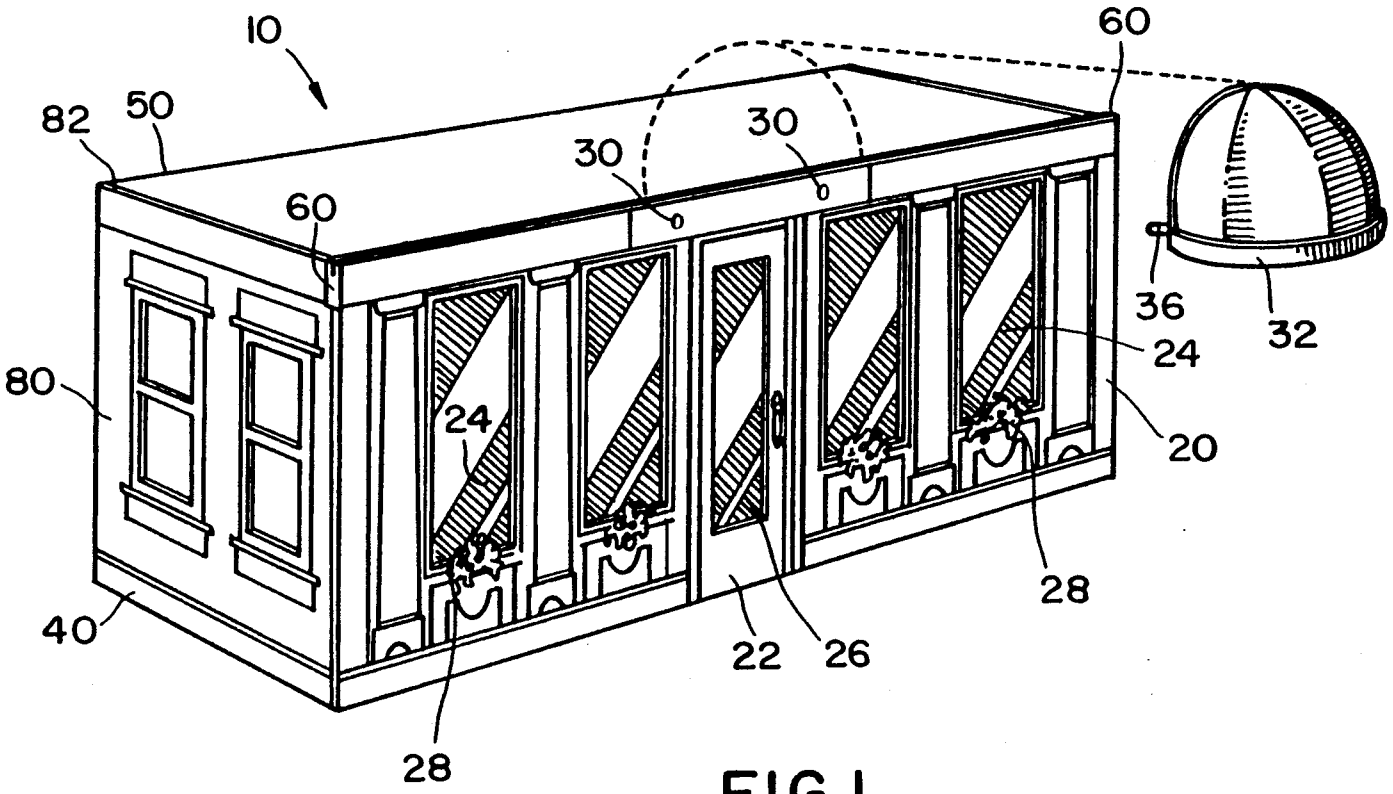
FIG. 1 is a perspective view of the front of the toy store in the storage position and showing the decorative canopy.

The front wall 20 has a lower edge, an upper edge, opposite sides, and is generally rectangular. Additionally, front wall 20 includes a centrally positioned door 22, and elongated windows 24 located on either side thereof. The door 22 and windows 24 may include clear plastic panes 26 so that it is possible to view the interior of the store. Also, as shown in FIG. 1, simulated flower boxes 28 are stenciled on to the wall beneath each window. Located in the upper edge of front wall 20 is a means 30 for mounting a canopy 32. The mounting means 30 comprises a pair of spaced apart cylindrical holes defining openings 34. In the illustrated embodiment, the canopy 32 includes a pair of projections or attachment means 36 which are adapted to be received within the openings 34.

The toy store 10 also includes a rectangular floor member 40 having opposite sides and front and rear edges. The front edge is connected to the bottom edge of the front wall by suitable means such as glue, screws, nails or other means well known to those skilled in the art of doll house construction. The floor includes a decorative floor design 42 that, in the illustrated embodiment, simulates tiles and which segregates the store into different department areas, such as shoes, hats, accessories, etc. when appropriate display and additional accessories are provided. The floor design may be provided in the form of a decal, stenciled in place or by other suitable means. A groove 44 extends along the entire length of the rear edge of the floor member. Each of the respective sides mounts a closure means 46, such as hook and loop fasteners which assist in maintaining the toy store in its box-like configuration when not in use and in supporting the side walls when in use.

A ceiling member 50 is connected to the top portion of the front wall 20 so as to substantially overlie the floor member 40. The ceiling member 50 includes opposite sides 52,54, a front edge 56 and a rear edge 58. The front edge 56 includes a means 60 for receiving a facade wall 70 as will be described in greater detail hereinbelow. In the illustrated embodiment, the means 60 takes the form of a groove extending substantially along the entire length of the front edge 56. A means for closing the toy store 10 is provided in the form of a downwardly extending U-shaped member 59 extending along the rear edge 58 of ceiling member 50.

A facade wall 70 is provided and forms the front wall of the second floor when the toy store is in use (FIG. 2) and forms the rear wall of the first floor when the toy is being stored (FIG. 3). More specifically, the facade wall includes a plurality of windows 72 which may be stenciled on to the outer surface or may be actual see-through windows of plastic or other suitable materials (FIG. 3). Similarly, the interior side of the facade wall 70 includes designs appropriate thereto such as railings, wallpaper and the like. The upper edge includes an L-shaped overhanging lip 74 and a lower edge 76.

A side wall 80 is hingedly connected to each of the respective sides 52,54 of the ceiling member 50 by means of hinges 82 which may be metal, plastic or other suitable materials. Each side wall 80 is movable from a closed position wherein the free end of the side wall 80 is detachably connected to the floor member 40 and is movable to a vertical position to define second floor side walls when the toy store is in use. Located proximate the free edge of both the inner and outer faces of side walls 80 are hook and loop or other similar fastening means 46.

Figure 4:
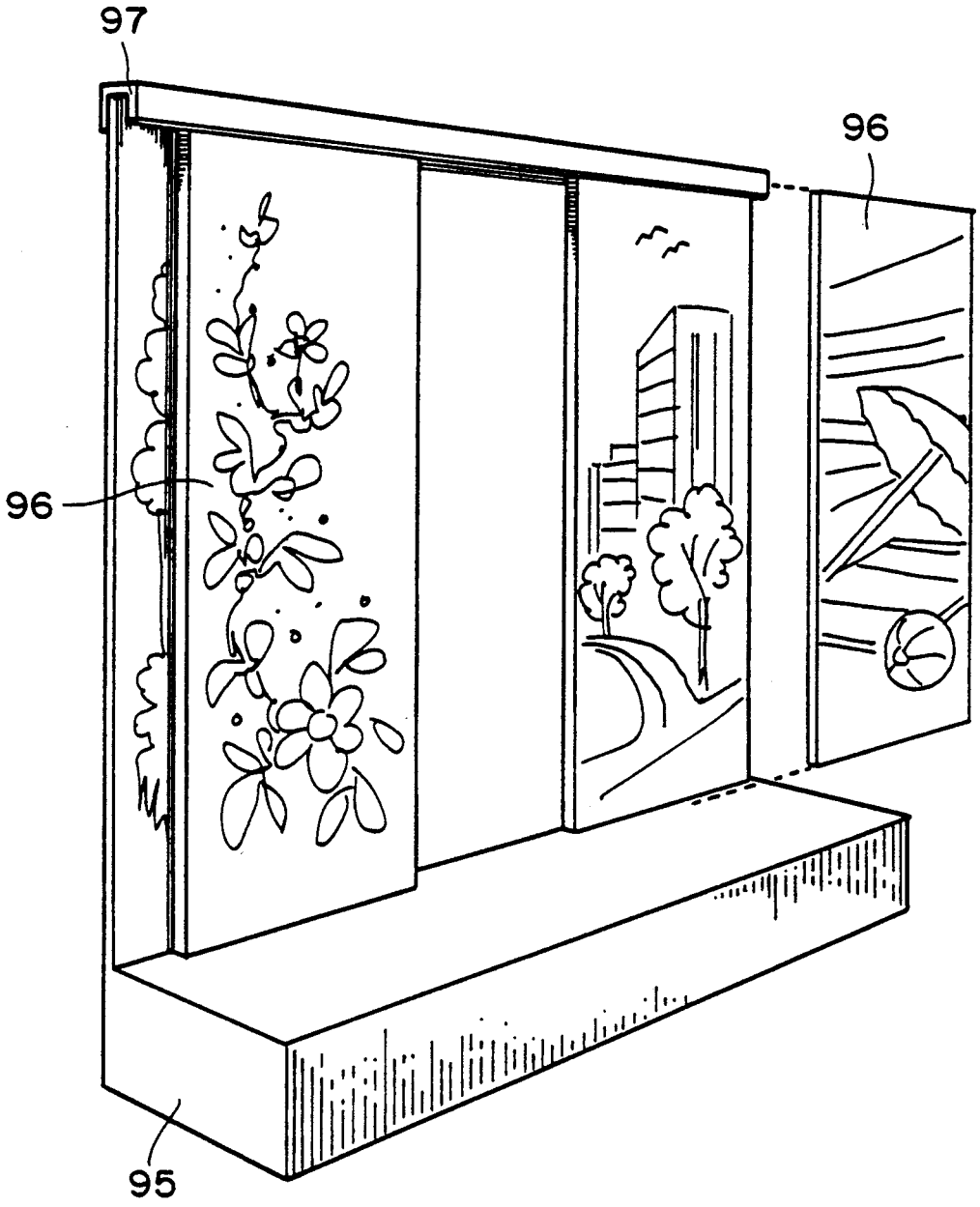
FIG. 4 is a perspective view of the decorative window display unit with the interchangeable decorative panels.

The toy store also includes accessories such as a movable stage 90 which is positionable along the length of the facade wall 70 and which slides within the L-shaped lip 74. In addition, on the first floor, located behind each of the windows 24 are decorative display units 95 which are attached to the floor by hook and loop fasteners (not shown) or by other suitable means. The displays include channel means for interchanging the decorative backgrounds or panels 96 which may be interchanged as shown in FIG. 4.

The toy store, when not in use is stored as a six-sided box. The sides 52,54 are connected via the hook and loop fasteners to the floor member 40. Also, the facade wall 70 is inserted between the floor member 40 and the ceiling member 50 with its lower edge pressure fitted within groove 44 and its lip 74 positioned within the downwardly extending member 59.

Figure 2:
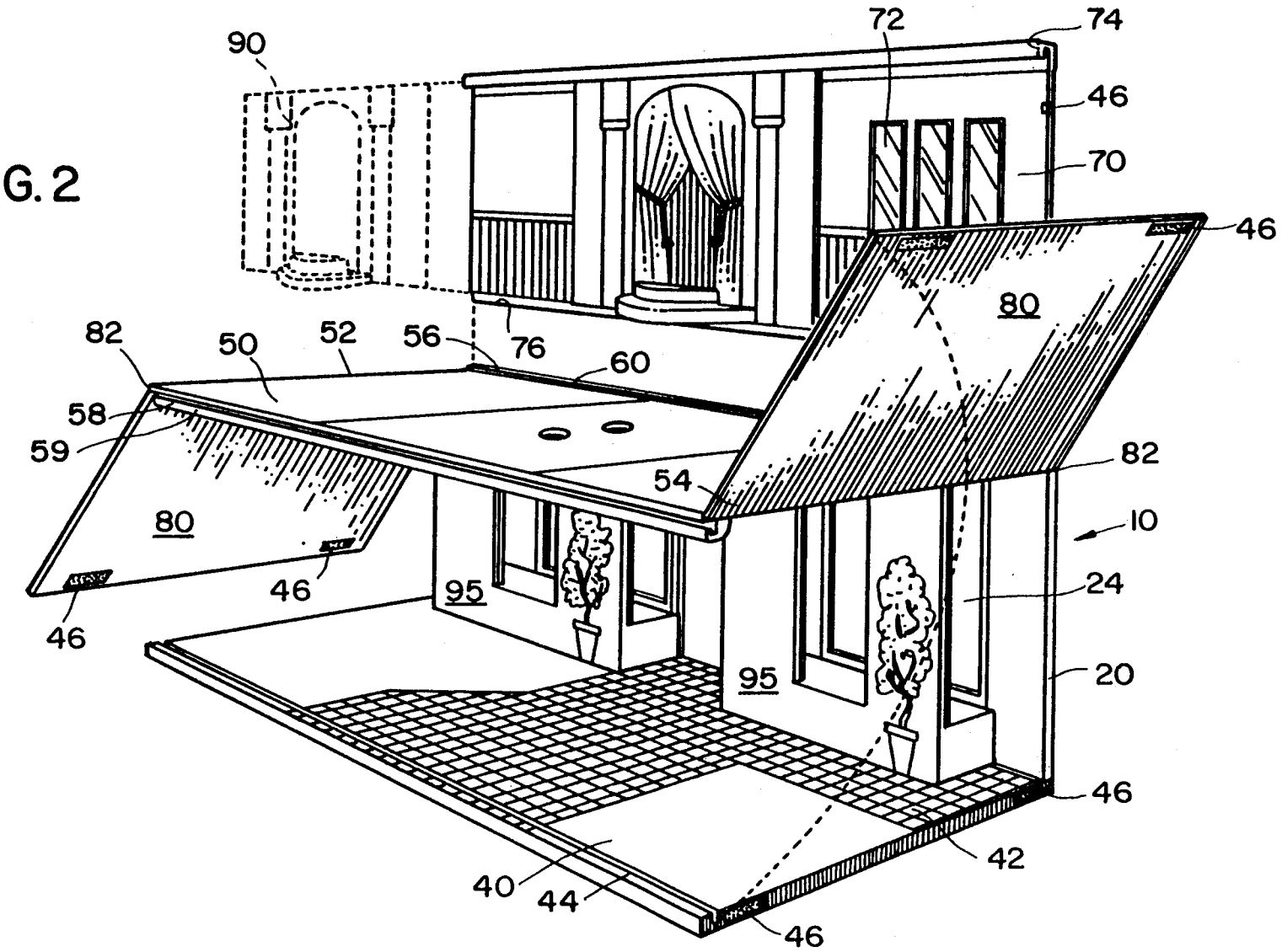
FIG. 2 is a perspective view of the rear of the toy store showing the second story partially assembled.

When it is desired to use the store 10, the second floor is constructed by removing the facade wall 70 from between the floor member 40 and the ceiling member 50 and positioning the lower edge 76 within groove 60 at the front of the store. The stage accessory 90 is then slid into position on the second floor as illustrated in FIG. 2 and the sides 52,54 are moved into the vertical position and are held in place by hook and loop fasteners 46 or other suitable means, thus completing the second floor.

The foregoing embodiments and examples are to be considered illustrative, rather than restrictive of the invention, and those modifications which come within the meaning and range of equivalence of the claims are to be included therein.

That which is claimed is:

1. A toy store comprising:

a vertical front wall;

a floor member connected to said front wall along its bottom portion;

a ceiling member connected to said front wall along its top portion and substantially overlying said floor member;

a movable facade wall including a bottom edge and a connecting means, said facade wall being movable between an in use position wherein said lower edge is connected to said ceiling member and a storage position wherein said connecting means connects said facade wall between said floor member and said ceiling member; and a side wall hingedly connected to each of the respective sides of said ceiling member, each side wall being movable from a closed position wherein the free end of the side wall is detachably connected to the floor member and is movable to a vertical position to define second story side walls.

2. The toy store according to claim 1 wherein said ceiling member includes a groove adapted to receive the lower edge of said facade wall.

3. The toy store according to claim 2 wherein the upper edge of each facade wall includes projection means adapted to slidably receive a toy store display accessory when the toy store is in use, and further wherein the edge of said ceiling member opposite said front wall includes means for receiving said projection means when said toy store is in storage.

4. The toy store according to claim 1 wherein said front wall defining the outside of the toy store includes windows, a door and a detachable canopy, said detachable canopy including attachment means for detachably connecting said canopy to said front wall.

5. The toy store according to claim 4 further including window display units supporting decorative backgrounds positioned on said floor member behind said windows.

6. The toy store according to claim 5 wherein said decorative window display units include channel means for varying said decorative backgrounds.

7. The toy store according to claim 3 wherein said display accessory comprises a stage adapted to be slidably positioned along the interior facing side of said facade wall.

8. A toy store comprising:

a vertical front wall including a door, windows and a detachable canopy adapted to be positioned above said door and including attachment means for detachably connecting said canopy to said front wall;

a floor member connected to said front wall along its bottom portion;

a ceiling member connected to said front wall along its top portion and substantially overlying said floor member, said ceiling member further including a groove means proximate the front wall connected edge thereof;

a movable facade wall including a bottom edge and a connecting means, said facade wall being movable between an in use position wherein said lower edge is connected to said ceiling member and a storage position wherein said connecting means connects said facade wall between said floor member and said ceiling member; and a rectangular side wall hingedly connected to each of the respective sides of said ceiling member, each side wall being movable from a closed position wherein the free end of the side wall is detachably connected to the floor member and is movable to a vertical position to form second-story side walls.

* * * * *